US006383121B1

(12) United States Patent
Galasso et al.

(10) Patent No.: US 6,383,121 B1
(45) Date of Patent: May 7, 2002

(54) AQUA BIKE

(75) Inventors: Lydie Galasso; Pepito Joseph Alvarez, both of Saint Jean Cap Ferrat (FR)

(73) Assignee: Aqua Bike, Du Moulin (MC)

( * ) Notice: Subject to any disclaimer, the term of this patent is extended or adjusted under 35 U.S.C. 154(b) by 0 days.

(21) Appl. No.: 09/374,127

(22) Filed: Aug. 9, 1999

Related U.S. Application Data

(63) Continuation of application No. PCT/IB98/00159, filed on Feb. 9, 1998.

(30) Foreign Application Priority Data

Feb. 11, 1997 (MC) ..... 2367

(51) Int. Cl.[7] ..... A63B 21/008
(52) U.S. Cl. ..... 482/111; 482/57
(58) Field of Search ..... 482/57, 58, 63, 482/111

(56) References Cited

U.S. PATENT DOCUMENTS 4,962,925 A * 10/1990 Chang ..... 272/73
5,029,846 A * 7/1991 Hao ..... 272/73
5,106,078 A 4/1992 Rowe ..... 482/138
5,354,253 A * 10/1994 Awbrey et al. ..... 482/111
5,372,562 A * 12/1994 Chang ..... 482/57
5,423,728 A * 6/1995 Goldberg ..... 482/57
5,921,892 A * 7/1999 Easton ..... 482/54

FOREIGN PATENT DOCUMENTS

WO WO-9503093 * 2/1995 ..... 36/63

* cited by examiner

*Primary Examiner*—Jerome W. Donnelly
*Assistant Examiner*—Tam Nguyen
(74) *Attorney, Agent, or Firm*—Darby & Darby

(57) ABSTRACT

Apparatus for the practicing of gymnastics in the water without the linear movement of the user, including a frame, pedal mechanism, a system of transmission by means of a cascade of pinions, adjustable blades which allow a more or less great resistance of the water and a means of supporting the user either in a seated vertical position, for the exercising of his lower limbs, seat, handlebars or in a horizontal position, for the exercising of the upper limbs after modifications to the seat and the handlebars.

8 Claims, 5 Drawing Sheets

FIG. 4B
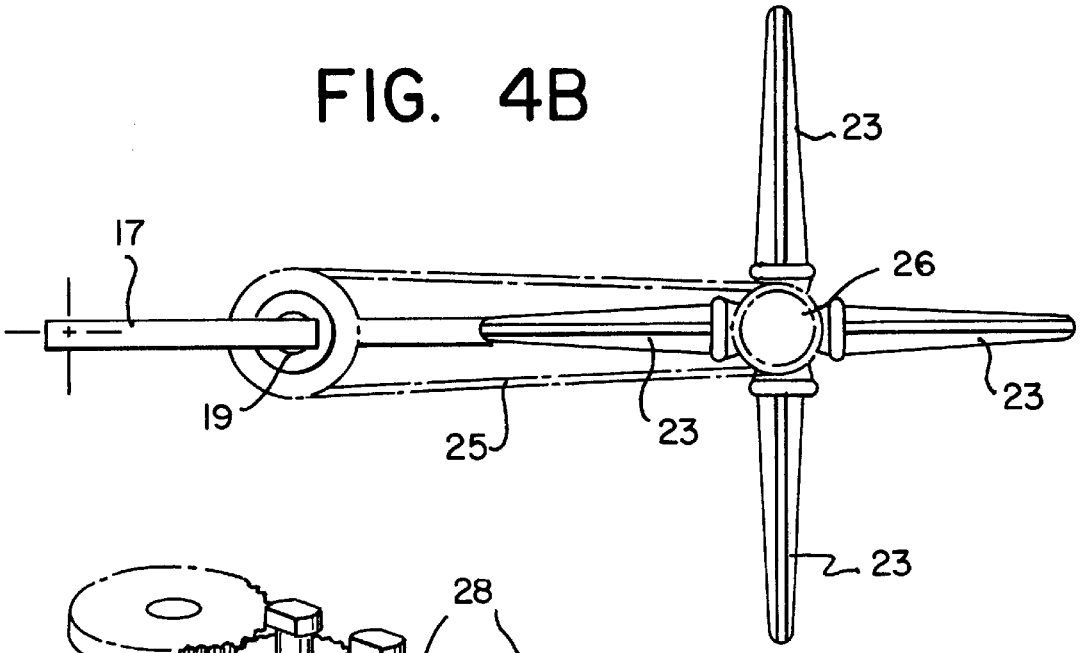
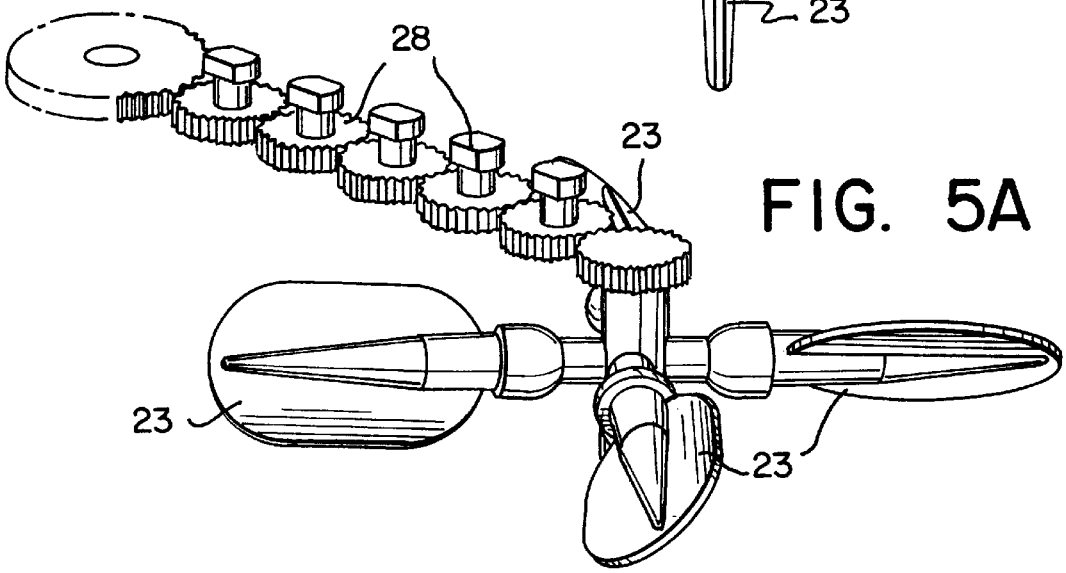
FIG. 5A
FIG. 5B
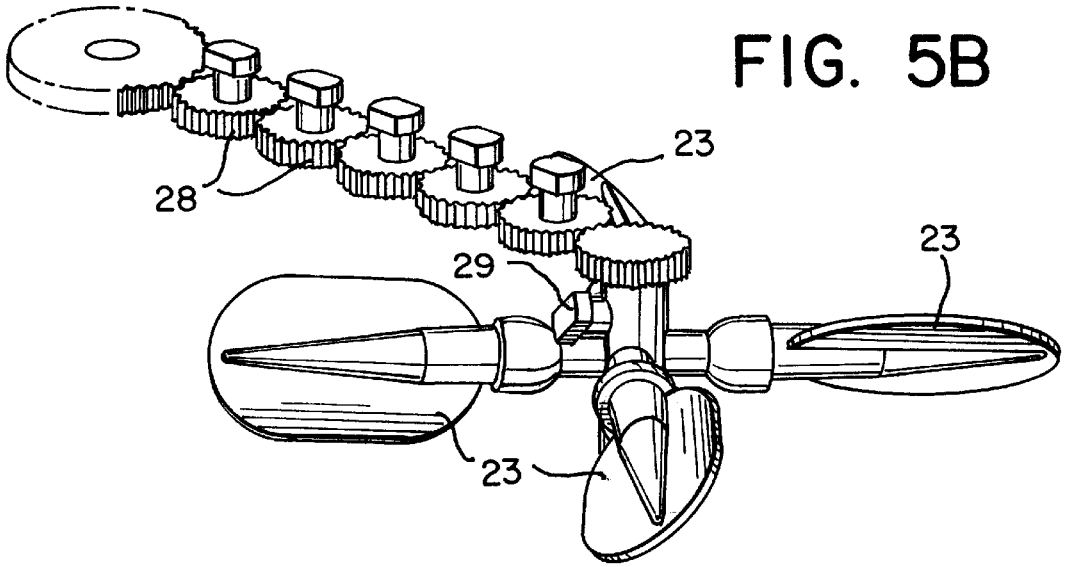

AQUA BIKE

This is a continuation of international application Serial No. PCT/IB98/00159, filed Feb. 9, 1998, which designated the United States of America.

FIELD OF THE INVENTION

Apparatus allowing the practicing of physical exercise in the water without translational movement, by means of a pedal mechanism in the style of a velocipede, providing an adjustable degree of resistance and requiring a controlled effort.

BACKGROUND OF THE INVENTION

Numerous forms of velocipedes and bicycles are known and used to allow their users to travel on land or on the sea. There have also been flying machines or machines which are intended to fly, driven by a pedal mechanism according to the principle used for bicycles.

The device always includes a pedal mechanism driving a toothed wheel or plate, transmitting the movement via a belt or chain to another set of toothed wheels or pinions of different diameters, integral with either a rear wheel initiating the movement along the ground, or with a device for propelling the apparatus in the water. The set of toothed wheels may be selected by means of a derailleur at will by the user. It is often also the case that the pedal mechanism itself includes several toothed plates integral with the pedals for use also at will by means of another selecting device called a derailleur.

All these machines were designed to allow the linear movement of the user on land or on the sea using his own physical force and more particularly by means of the action of the lower limbs on two pedals integral with a toothed plate.

There also exists a type of apparatus equipped with a similar device also powered by the upper limbs such as in tricycles designed for persons with partial motor impairment.

Such apparatus and devices allow the transformation of a circular movement produced by the lower or upper limbs, into a linear movement.

Moreover it is now a well-known fact that gymnastic movements or physiotherapy treatment carried out in the water are beneficial. However, such treatment and movements have until now been practiced without the aid of any apparatus, whereas with the piece of apparatus which is the subject matter of the invention described below, the results are more beneficial and more pronounced.

The invention uses the same principles as used in the velocipedes mentioned above which do not allow a linear movement of the user, but in order to have him exert a physical effort using his lower or upper limbs by means of the apparatus which is the subject of the present invention, without causing him to move.

This apparatus is designed to be used in a swimming pool, or a bath or tank filled with water, as an apparatus for practicing a particular type of gymnastics in the water or as an apparatus for thalassotherapy.

One of the advantages of this apparatus is its ability to be assembled, and fixed rapidly and easily either onto the edge or onto the bottom of a pool, swimming pool or tank filled with water. The bike may also be suspended on a stainless steel ladder or polyester support, on the edge of the pool. Another advantage is the ease with which it can be dismantled, removed and transported.

The apparatus designed to be used under water, does not include wheels resting on the ground, but has a certain number of adjustable blades, fixed onto a rear hub, which may notably be four in number. Preferably, it is entirely submerged so that the rider can pedal in water which comes up to his pelvis. The blades are moved by a pedal mechanism using the force of the user's lower limbs when in a seated position.

But this apparatus, whilst remaining within the scope of the invention, may undergo some modifications to the frame, the seat and the handlebars in order to support the user in a position which allows him to carry out physical exercise which is just as beneficial with his upper limbs, that is by the arms in a horizontal position and not by the legs in a vertical position as realized and described above.

The water in which the blades move provides the resistance sought after in this effort exerted by the user whether it is for the lower part of the body in a seated vertical position or for the upper part of the body by the upper limbs in a horizontal position.

An important feature is the ability to achieve several levels of resistance, with the aim of improving the effort, range of movement and progression as part of an aquatic fitness program or simply a program of physiotherapy. The blades preferably include a device allowing their adjustment to different angles to allow them to increase or reduce the resistance from water, and therefore to modify the effort to be employed.

It should be noted that the orientation of the blades must be in opposite directions in order to avoid the apparatus from moving to one side.

As a result of the total or virtually total immersion in corrosive water (sea water, water containing various specific products) or in water which may reach 37 or 38 degrees centigrade, the material used for the construction of the frame of the apparatus and the accessories will preferably be nylon, polyester or a thermosetting compound material, but not metal, which would not resist corrosion or oxidation.

BRIEF DESCRIPTION OF THE DRAWINGS

The foregoing brief description and further objects, features and advantages will be understood more completely from the following detailed description of presently preferred embodiments, with reference to the accompanying drawings, in which:

FIGS. 5A and 5B represent the second transmission system called a cascade of pinions (one pinion driving the next and so on);

DETAILED DESCRIPTION OF THE PREFERRED EMBODIMENT

Figure 1:
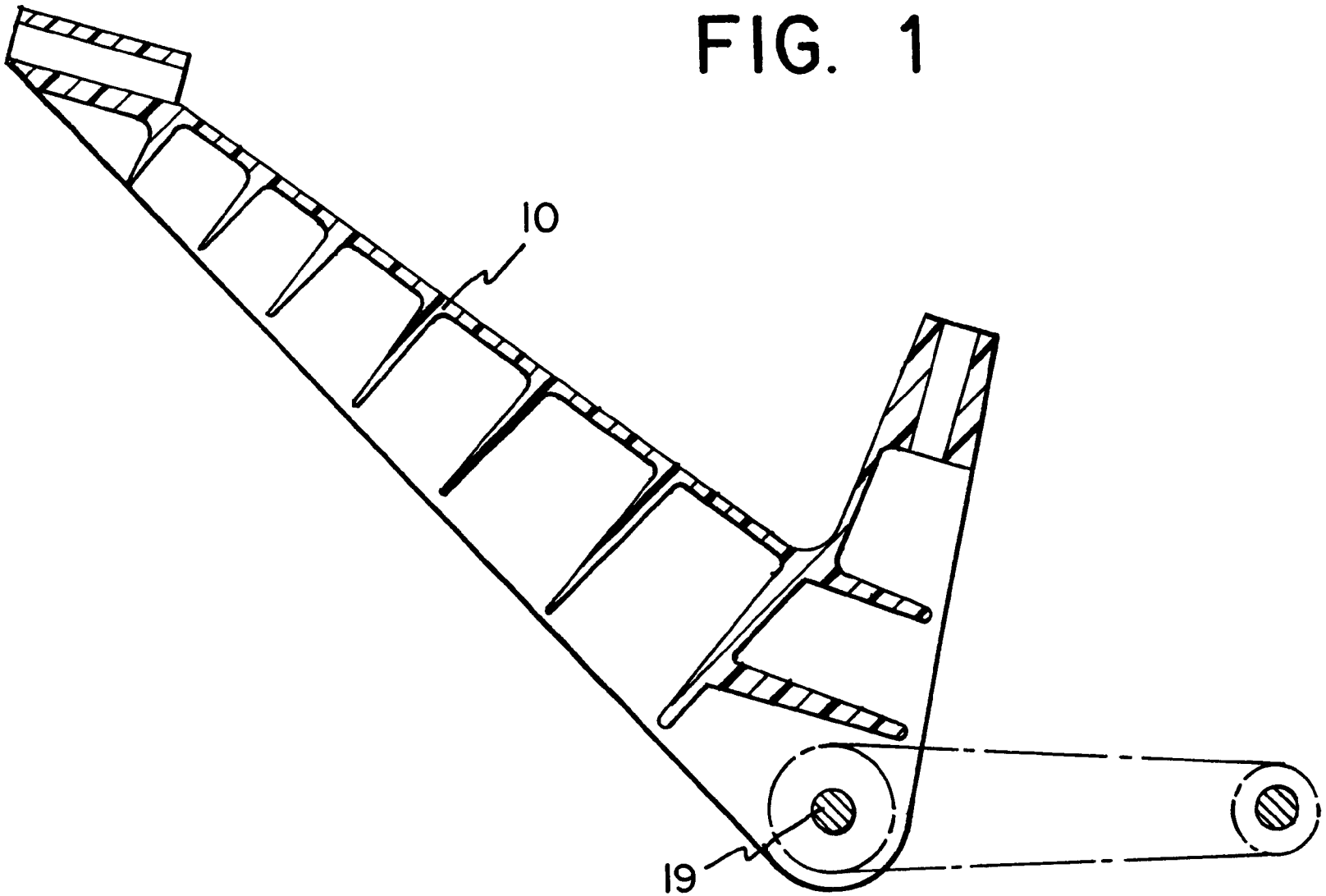
FIG. 1 is a plan view, partially in sections of the front frame of a presently preferred embodiment of the aqua bike.
Figure 2A:
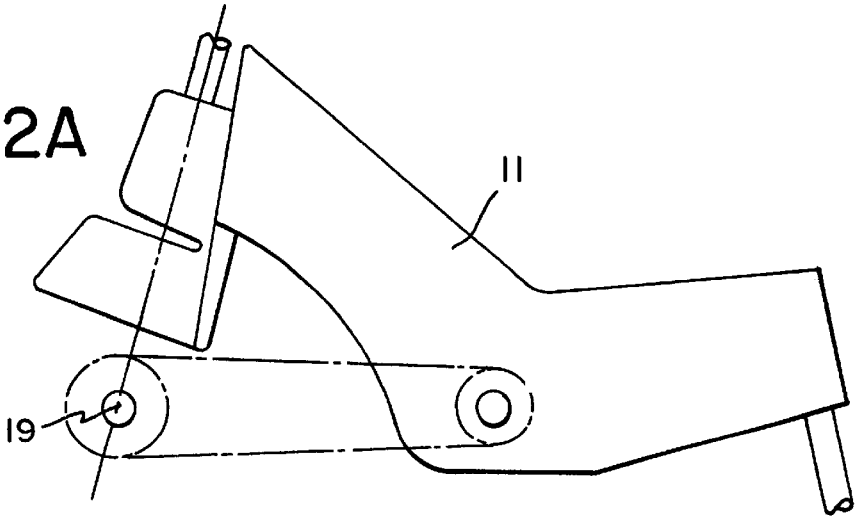
FIG. 2 illustrates part of the rear frame of the aqua bike.
Figure 2B:
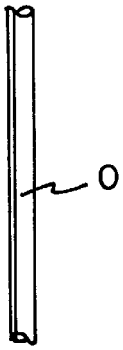
Figure 2C:
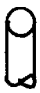
Figure 4A:
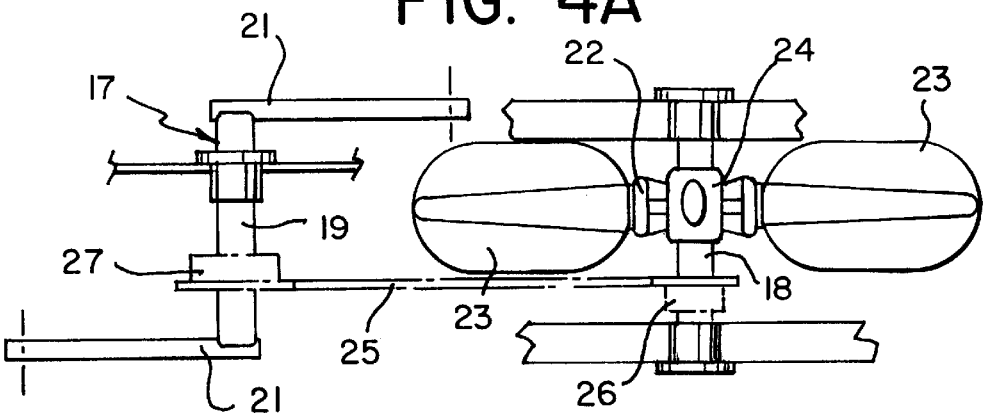
FIG. 4 represents the front and rear axles with pulleys, cranks and system.

One preferred way of realizing the invention includes a frame 10 and 11 made for example of polyester or nylon according to the representation made in FIGS. 1 and 2.

The frame may either be supported by arms which are fixed at the rear to the edge of a swimming pool, pool or tank and, at the frame's center of gravity, at pedal height, by a leg resting on the bottom of the pool.

Figure 6A:
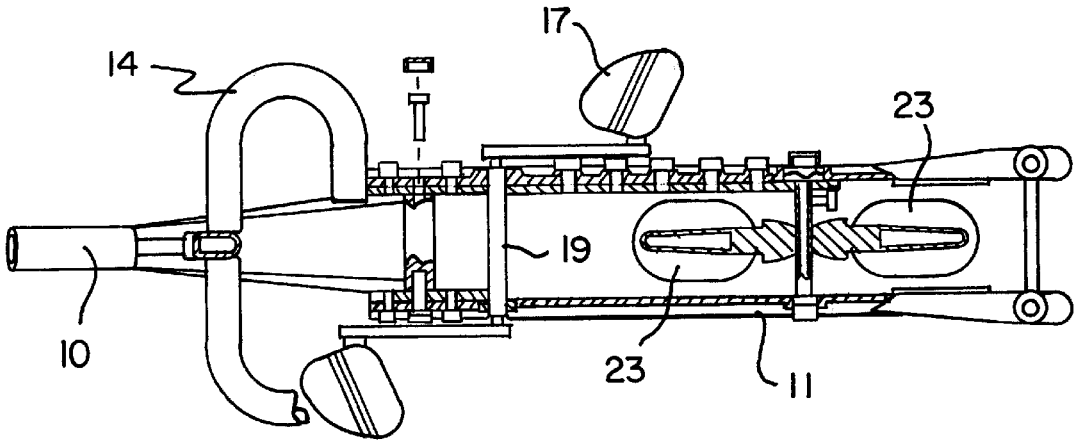
FIGS. 6A and 6B are top and side views of the aqua bike with parts in sections.
Figure 6B:
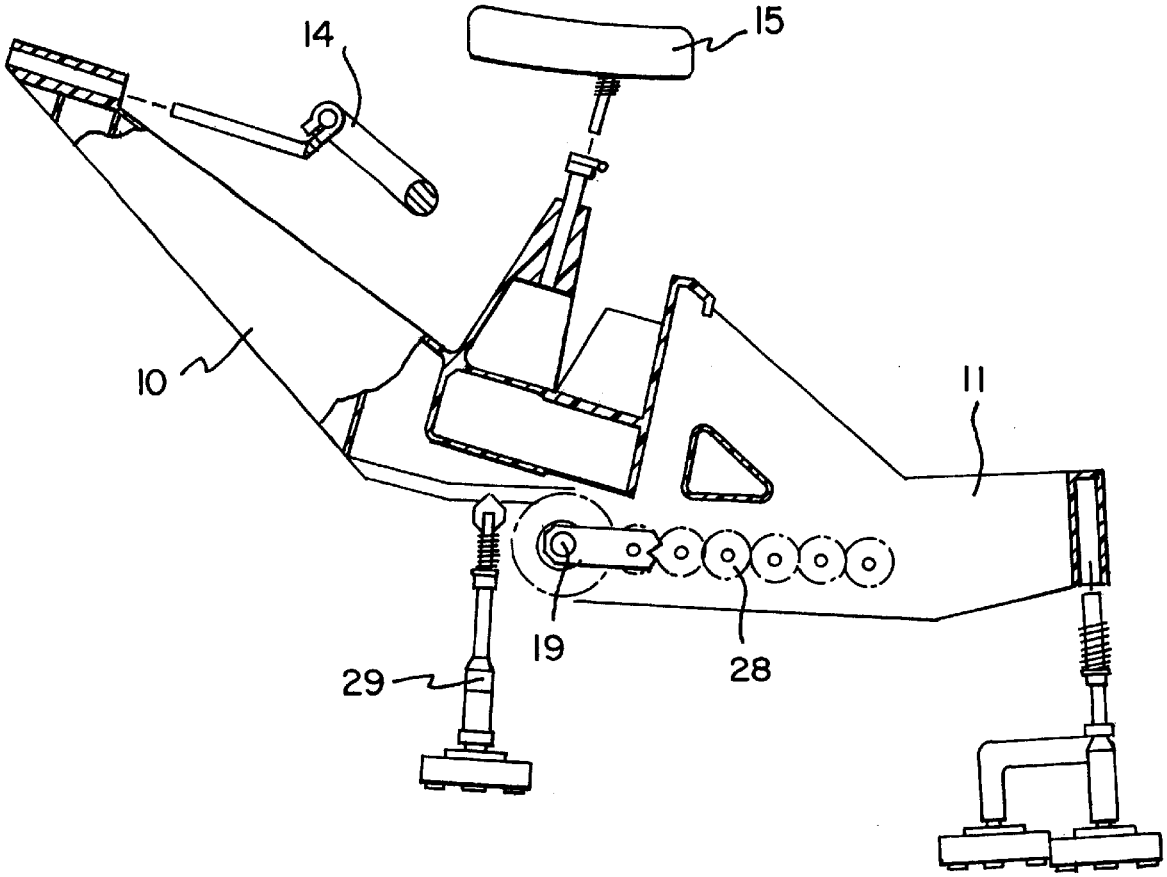
Figure 7:
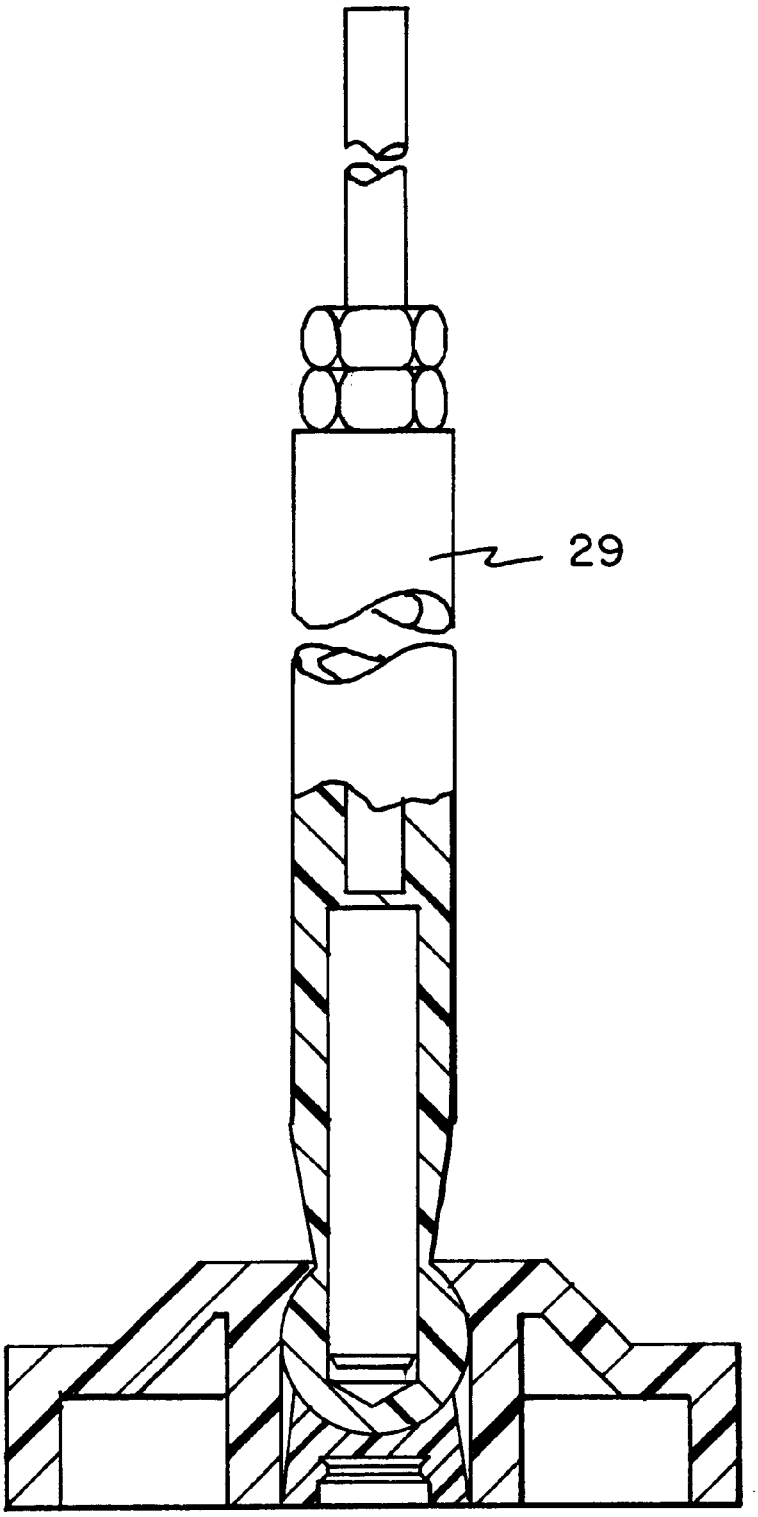
FIG. 7 shows the leg of the aqua bike, with parts in section.

The frame may be supported with a leg resting on the bottom of the swimming pool at the center of gravity at pedal height, by two other height adjustable legs fitted into the arms situated at the end of the frame and thus allowing the apparatus to rest with its three legs on the bottom of the pool as represented in FIG. 6.

The frame may be supported in any other way by four height adjustable legs.

A representation of the invention for use by the lower limbs in a seated vertical position is given by the enclosed drawings, which show:

The frame of the apparatus, plates 1 and 2, which may be a single rigid piece or in two parts allowing it to be given an adjustable conformation.

Two arms 11 which may be fixed at the rear to the edge of the swimming pool or onto the rungs of a ladder made of a non-oxidizing material itself fixed onto the edge of the swimming pool.

A removable seat 15 of comfortable dimensions made of polyester, which may tilt forward or back, fixed on a sliding height adjustable seat post.

Figure 3:
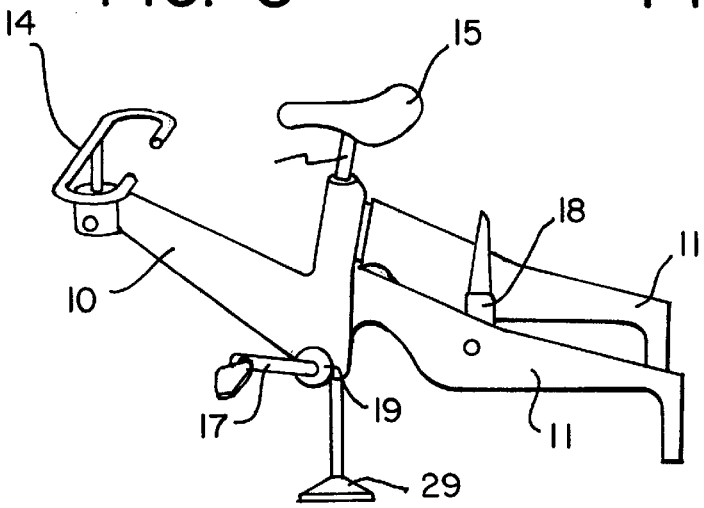
FIG. 3 represents a view of the aqua bike with its pedaling and transmission systems.

Removable handlebars 14 at the front, of any shape, but which may also be tilted, fixed onto a stern sliding upwards and downwards inside a tube which is integral with the frame. A pedal mechanism 17 is fixed onto a front axle 19, see FIG. 3.

A drive system and its system of transmitting the effort to the rear shaft by means of a cascade of pinions 28, see FIG. 5. The pinions in the cascade of pinions shown in FIGS. 5A and 5B are arranged coplanar with one another.

A certain number of blades 23 adjustable to different angles, preferably four in number, fixed onto an axle 22, 24 at the rear of the frame 25 and a leg whose height is adjustable using a screw jack or tube 29 fixed under the frame directly below the seat, and which rests on the bottom of the swimming pool.

Although preferred embodiments of the invention have been disclosed for illustrative purposes, those skilled in the art will appreciate that many additions, modifications and substitutions are possible, without departing from the scope and spirit of the invention as defined by the accompanying claims.

What is claimed is:

1. An aqua bicycle for submergence into a swimming pool, comprising:

a frame;

a seat;

a pedal mechanism mounted to said frame for rotatable motion;

a seat post mounted for height-adjustable slidable motion relative to the frame whereby an adjustable mechanism is provided to vary the distance between the seat and the pedal mechanism to accommodate a length of a user's legs;

a leg positioned below a center of gravity of said pedal mechanism and configured to rest on the bottom of the swimming pool, the leg supporting the aqua bicycle away from the bottom of the swimming pool;

a rear shaft;

a set of blades mounted for rotation about the rear shaft; and a cascade of co-linear pinions positioned between said pedal mechanism and said rear shaft to inter-engage each other and drive said set of blades into rotation in response to rotation of said pedal mechanism and without the use of a belt, a screw jack for adjusting the height of the frame, the screw jack being operatively connected as a second adjustable mechanism to adjust the frame relative to the leg and thereby to vary the position of the seat relative to the water level of the swimming pool and permit a user to breath while in a seated position on the aqua bicycle, wherein said frame is adjustable to support the aqua bicycle such that said set of blades is submerged in the swimming pool.

2. The aqua bicycle as claimed in claim 1, wherein said frame has at least two arms, each arm having a height adjustable leg configured to support the aqua bicycle on the bottom of the swimming pool.

3. The aqua bicycle as claimed in claim 1, wherein the pinions in the cascade of pinions are coplanar with one another.

4. The aqua bicycle as defined in claim 3, wherein said frame has an integral tube for adjustable and slidable connection of handle bars.

5. The aqua bicycle as defined in claim 4, further comprising handle bars.

6. The aqua bicycle as defined in claim 3, wherein a number of the blades in said set of blades are adjustable to different angles in order to prevent the aqua bicycle from moving to one side.

7. The aqua bicycle as defined in claim 3, wherein said frame is made from a material selected from the group of nylon, polyester and a thermosetting compound other than metal.

8. An aqua bicycle for submergence into a swimming pool, comprising:

a frame;

a seat;

a pedal mechanism mounted to said frame for rotatable motion;

a seat post mounted for height-adjustable slidable motion relative to the frame whereby an adjustable mechanism is provided to vary the distance between the seat and the pedal mechanism to accommodate a length of a user's legs;

a leg positioned below a center of gravity of said pedal mechanism and configured to rest on the bottom of the swimming pool, the leg supporting the aqua bicycle away from the bottom of the swimming pool;

a rear shaft;

a set of blades mounted for rotation about the rear shaft; and a cascade of co-linear pinions positioned between said pedal mechanism and said rear shaft to interengage each other and drive said set of blades into rotation in response to rotation of said pedal mechanism and without the use of a belt, a tube fixed under the frame directly below the seat, the tube permitting height adjustment of the leg relative to the frame in a telescoping manner to vary the position of the seat relative to the water level of the swimming pool and permit a user to breath while in a seated position on the aqua bicycle, wherein said frame is adjustable to support the aqua bicycle such that said set of blades is submerged in the swimming pool.

* * * * *